US005704832A

United States Patent [19]

Borrell

[11] Patent Number: 5,704,832

[45] Date of Patent: Jan. 6, 1998

[54] AIR CONDITIONER CONTROL ASSEMBLY

[76] Inventor: Gustavo Borrell, 1800 NW. 24th Ave., #108, Miami, Fla. 33125

[21] Appl. No.: 615,870

[22] Filed: Mar. 14, 1996

[51] Int. Cl.[6] ..... B60H 3/02

[52] U.S. Cl. ..... 454/157; 422/124

[58] Field of Search ..... 454/328, 157; 422/124, 123; 239/56, 57, 60

[56] References Cited

U.S. PATENT DOCUMENTS

| | | | |
|---|---|---|---|
| 4,654,198 | 3/1987 | Berardini | 422/124 |
| 4,722,264 | 2/1988 | DeGuisseppe | 422/124 |
| 4,813,344 | 3/1989 | Greif | 454/157 |
| 4,903,584 | 2/1990 | Styles | 239/60 |
| 5,087,273 | 2/1992 | Ward | 239/57 |

*Primary Examiner*—Henry A. Bennett
*Assistant Examiner*—Derek Boles
*Attorney, Agent, or Firm*—Malloy & Malloy, P.A.

[57] ABSTRACT

An air conditioning vent cover assembly to be disposed over an outlet vent of an air conditioner duct, and including a frame structured for secure, fitted engagement over the outlet vent. The frame itself includes an exterior face having a plurality of openings formed therein so as to permit air flow therethrough from the vent and provide an attractive exterior appearance. Furthermore, rotatably connected to the frame is at least one propeller assembly having a central hub and at least one blade extending from a perimeter of the central hub. The propeller assembly is structured to freely rotate as a result of air flow from the air conditioning duct flowing thereover, such that the air flow is dispersed and more evenly distributed into the room as it passes from the propeller assembly through the exterior face of the frame. In addition to evenly dispersing the air flow, the propeller assembly is equipped to distribute an air freshener into the air flow such that it will circulate into the room and provide it with a pleasant aroma.

18 Claims, 2 Drawing Sheets

FIG. 3
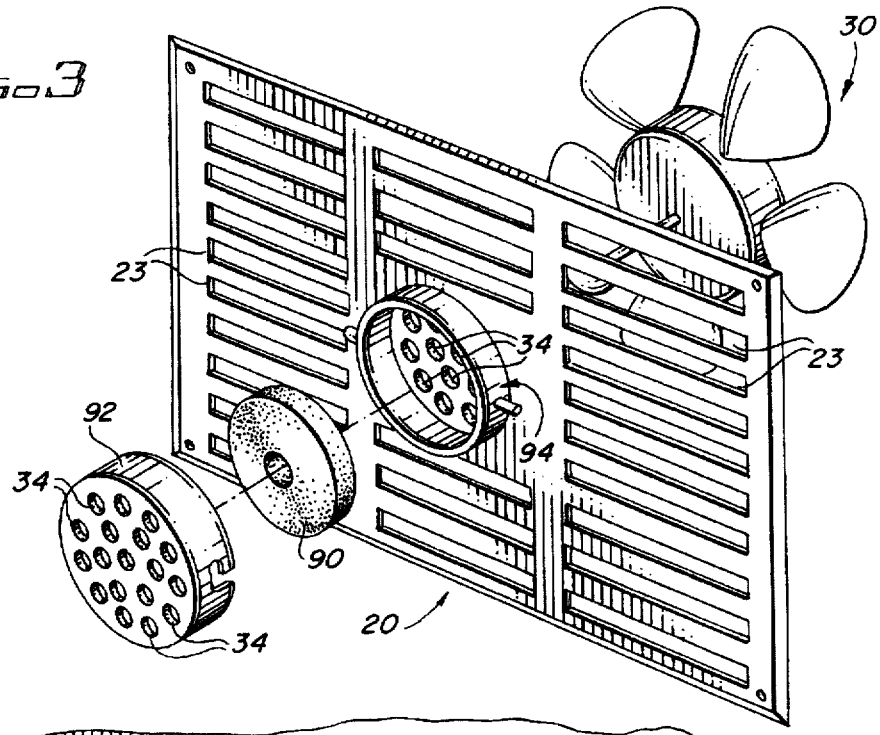
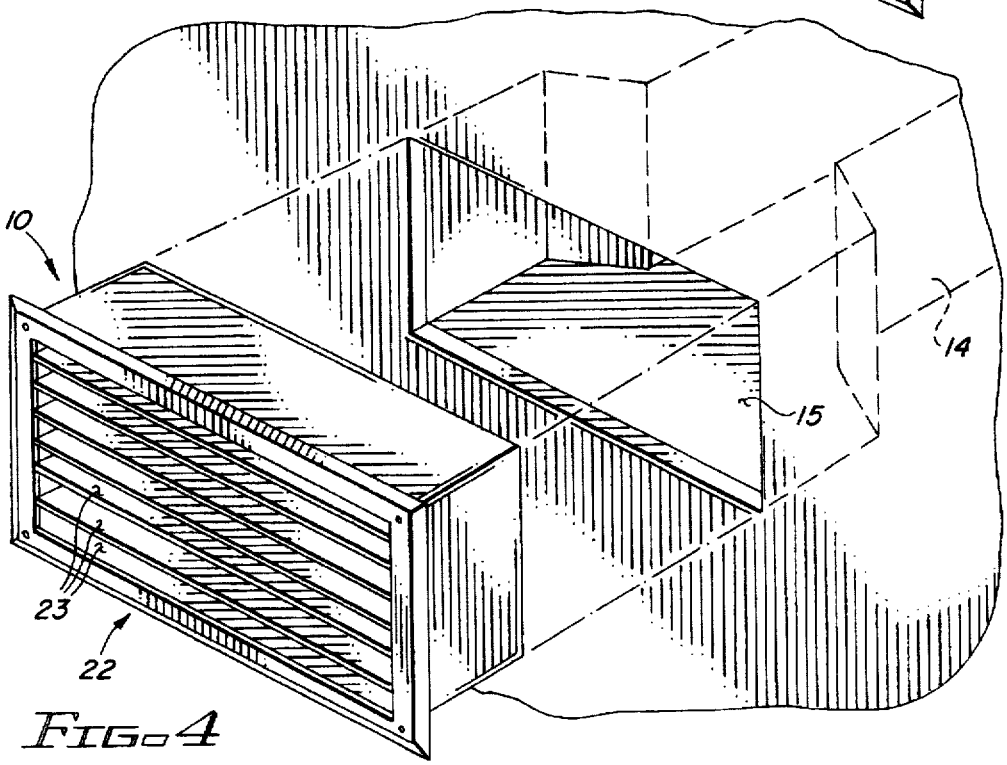
FIG. 4

AIR CONDITIONER CONTROL ASSEMBLY

BACKGROUND OF THE INVENTION

1. Field of the Invention

The present invention relates to an air conditioner vent cover assembly structured to be positioned over the outlet vent to an air conditioning duct in a wall or ceiling of a room, without significant adaptation or modification to the vent or the surrounding wall area, so that it evenly diffuses the air as it enters the room and also contains a fragrance or scent so that the air exits the air conditioner vent cover assembly with a pleasant aroma.

2. Description of the Related Art

Central air conditioning systems consist generally of a main unit supplying cool air through several air ducts which travel through the walls and ceiling of a structure. The cool air is then distributed to each room through an outlet vent strategically positioned in a wall or ceiling of the room.

In order to achieve a finished appearance, and/or in an attempt to direct the air into select portions of the room, the outlet vents are typically provided with a vent cover. Unfortunately, the options available with existing air conditioner vent covers are limited, and a user must often select between an attractive exterior appearance, and some directional control. Specifically, if a user chooses an attractive cover, having a decorative pattern formed therein, air flow entering the room will generally flow in a direct line from the vent. Furthermore, because the outlet vents are generally positioned in or near the ceiling, the conditioned airflow may be lost.

Accordingly, the most commonly utilized vent covers are those that direct the air flow down into the room. Generally, those types of covers are formed from thin steel or aluminum sheets and sized to fit completely around the outlet vent. Such vent covers have typically been provided with elongate slots, bounded by adjustably angled veins or flaps. Specifically, the veins permit a user to re-direct the air flow exiting the outlet vent to a desired location in the room. Unfortunately, however, while more effectively direct airflow into the room, the air is still concentrated at a specific location. In fact, it is frequently the case that an individual in the room who is in the path of the air flow will complain about the heavy draft and be too cold, while another individual outside of the path of airflow will not feel any air and will be warm. Moreover, the drafts produced by the focused airflow can often make individuals constantly in its path susceptible to frequent colds.

There is, therefore, still a substantial need in the art relating to air conditioning systems, and in particular central air conditioning systems, for a cost effective and easy to install assembly that will more effectively spread air flow into an entire room. Furthermore, there is a need for such a system which does not have to compromise an attractive appearance for functionality.

It will be noted that given the generally remote location of the air conditioner outlet vents, it is very impractical to implement some sort of motorized device, such as a device to alternate the position of the veins periodically. Accordingly, it would be beneficial to provide an assembly which effectively disperses the airflow whenever the air conditioning system is operating without requiring an electrical connection or battery supply and without requiring control communication with the air conditioning controls in order to begin functioning.

In addition to the problems associated with conventional air conditioner system outlet design, an important concern of individuals wishing to maintain a pleasant environment within a room relates to the smell of the room. Individuals are constantly utilizing various types of air freshener sprays and potpourri baskets in order to provide a pleasant aroma to the room. Further, individuals often desire different aromas in different rooms to provide some variety. As mentioned, when an individual wishes to freshen the air n a room they will often strategically place an air freshening device within the room. Inevitably, however, only the area very near the air freshener has a noticeable improved aroma. The general consumer dissatisfaction with such conventional air fresheners has led to the development of air fresheners that plug into the wall so as to melt a stronger air freshener gel, or to large more complex devices that attempt to circulate air therethrough. Inevitably, the air circulation air fresheners require prominent positioning to be effective, and require that a power source be available to make them operational. Further, because they are motorized devices, they are generally quite noisy and conspicuous. As a result, the most predominant type of air freshener utilized is still the spray or attractive potpourri basket.

Accordingly, it would be highly beneficial to provide an effective method of freshening the air within a room in an a cost effective, long lasting, easily implemented and inconspicuous manner. Such a device should blend with the existing environment of the room to provide consistent, effective air freshening.

SUMMARY OF THE INVENTION

The present invention is directed towards an air conditioner vent cover assembly which is structured to be functionally fitted over an existing outlet vent of an air conditioner duct. Specifically, the air conditioner vent cover assembly of the present invention includes a frame which is structured to provide secure fitted engagement of the assembly over the outlet vent. Further, the frame includes an exterior face which has a plurality of openings formed therein. The openings are conveniently disposed to permit airflow to exit the outlet vent therethrough.

The air conditioner vent cover assembly also includes at least one propeller assembly. The propeller assembly includes a central hub and at least one blade extending from a perimeter of the central hub. Furthermore, rotation means are connected between a central axis of the propeller assembly and the frame. The rotation means are structured to permit free rotation of the propeller assembly as a result of airflow from the air conditioning outlet vent flowing over the propeller assembly. Accordingly, the airflow passing through the propeller assembly is substantially dispersed as it exits the assembly through the exterior face of the frame, and can more evenly cool an area into which the outlet vent extends. Moreover, in order to disperse an air freshener into the air flow which passes through the assembly, scent dispersant means are also included. As such, the air is evenly dispersed, and a fresh scent is also evenly dispersed throughout a room.

It is an object of the present invention to provide an air conditioner vent cover assembly which adequately diffuses the air exiting the vent cover assembly, rather than merely re-directing it, so as to provide for increased, even air circulation in a room.

Another object of the present invention is to provide an air conditioner vent cover assembly which provides an attractive exterior appearance, but also functions to effectively diffuse air flow entering a room so as to achieve improved cooling of the room.

It is a further object of the present invention to provide an air conditioner vent cover assembly which is structured to diffuse the flow of air exiting the vent cover assembly which operates mechanically and does not require any electrical or battery power.

Yet another object of the present invention is to provide an air conditioner vent cover assembly which is structured to disburse a constant, even, and consistent level of perfume or fragrance into the airflow passing through the assembly so that the air exiting the air conditioning vent cover assembly has a pleasant aroma.

It is also an object of the present invention to provide an air conditioner vent cover assembly which effectively disburses a pleasant scent in a concealed, unobtrusive fashion, and with little or no modification to an existing air conditioning system.

An additional object of the present invention is to provide an air conditioner vent cover assembly which is substantially easy to install, requires little or no adaptation of existing air conditioning systems, is not highly noticeable despite its many functions, and substantially increases the effectiveness of an existing air conditioning system.

BRIEF DESCRIPTION OF THE DRAWINGS

For a fuller understanding of the nature of the present invention, reference should be had to the following detailed description taken in connection with the accompanying drawings in which:

FIG. 3 is a partially exploded, perspective view of the assembly, and in particular the scent dispersing means; and FIG. 4 is a perspective view showing the outlet vent and the air conditioning duct before the air conditioner vent cover assembly is attached.

Like reference numerals refer to like parts throughout the several views of the drawings.

DETAILED DESCRIPTION OF THE PREFERRED EMBODIMENT

Figure 2:
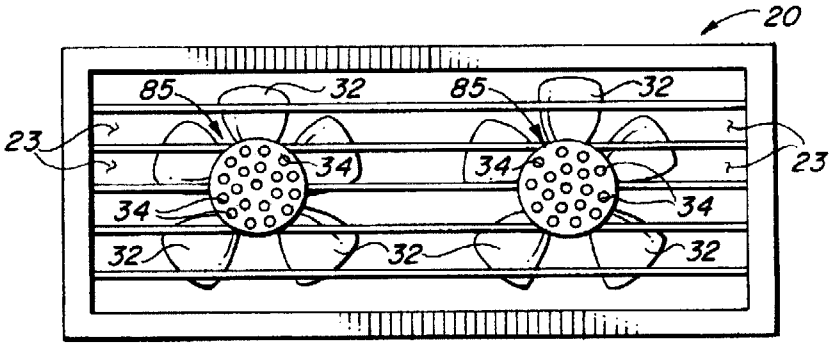
FIG. 2 is a front view of the air conditioner vent cover assembly.

Shown throughout the figures, the present invention is directed towards an air conditioning vent cover assembly, generally indicated as 10. The air conditioning vent cover assembly 10 is structured for use with an air conditioning system, and although useable with a variety of types of air conditioning devices, preferably with a central air conditioning system. Generally, the air conditioning system is of the type that includes at least one air conditioning duct 14, through which air flows, and an outlet vent 15, from which the air enters a select location and to which the vent cover assembly 10 of the present invention is secured.

In particular, the air conditioner vent cover assembly 10 of the present invention includes a frame 20 structured for secure, fitted engagement over the outlet vent 15. The frame 20 includes an exterior face 22 that is preferably structured to substantially cover and conceal the outlet vent 15 when properly positioned. Moreover, the frame 20 is preferably large enough such that its exterior face 22 extends beyond a perimeter of the outlet vent 15 to completely conceal the wall opening through which the outlet vent 15 extends, and defines a retention flange which maintains a substantially flush exterior appearance without permitting a remainder of the frame 20 from being over-inserted into the outlet vent 15. Nevertheless, it will be appreciated that all or part of the frame 20 may be structured to protrude from the outlet vent 15 or extend about an exterior thereof if desired, and the entire frame 20 may include only the exterior face 22 fastened in place. Further, given the variety of outlet vent configurations available, the frame 20, which may be constructed of a wide variety of materials such as steel, aluminum, plastic, rigid vinyl, and the like, can be shaped in several alternative forms to fit various different sized outlet vents 15.

Figure 2A:
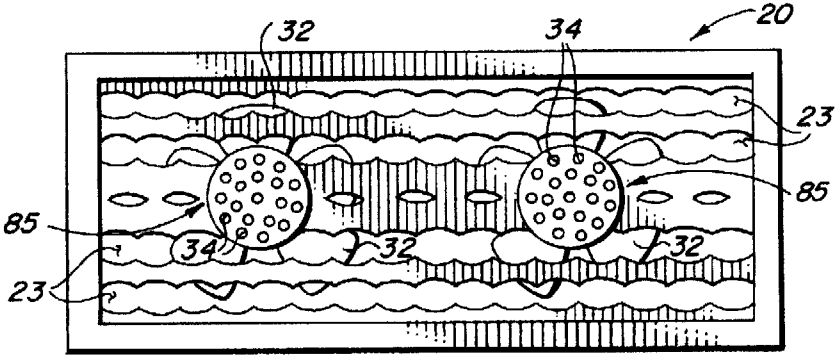
FIG. 2A is a front view of the air conditioner vent cover assembly showing a decorative exterior face.

The exterior face 22 of the frame 20, which is the externally visible portion of the assembly 10, also includes a plurality of openings 23 formed therein. The openings 23 are structured to permit the free exit of airflow from within the outlet vent 15 therethrough. In a first preferred embodiment of the present invention as in FIG. 2A, the openings 23 will be configured to provide the exterior face 22 of the frame 20 with an attractive, decorative appearance. For example, the exterior face 22 could be structured with an attractive brass finish, and the openings 23 positioned to define a decorative pattern that enhances the overall appearance of a room in which the outlet vent 15 is located. Moreover, due to the structure of the present invention, as will be described in greater detail subsequently, directional veins which seek to "aim" the air flow are not necessary as part of the exterior face 22. Rather, the decorative component of the exterior face 22 can be maximized so long as the plurality of openings Z3 permit the substantially free flow of air therethrough. Nevertheless, however, in an alternative embodiment of the present invention, the exterior face 22 of the frame 20 can include a number of directional veins, if a user wishes to have the ability to focus airflow in a select direction, or a generally grille-type configuration, if a more uniform look is desired.

The air conditioner vent cover assembly 10 of the present invention is structured to diffuse the air exiting the outlet vent 15 as it passes therethrough. As a result, the air exiting the outlet vent 15 is not merely focused at a particular point in the room, where it must rely on redirection by the walls of the room, but rather it more evenly circulates and spreads out as it exits the assembly 10. In order to achieve the effective diffusion of exiting air, the air conditioner vent cover assembly 10 includes at least one, but preferably a pair of propeller assemblies 30. Each propeller assembly 30 is preferably constructed of a lightweight material, such as plastic, rigid vinyl, or aluminum, and functions to diffuse the straight stream of air flowing through the air conditioning duct 14.

Each of the individual propeller assemblies 30 includes primarily a central hub 31 and at least one blade 32 extending from a perimeter of the central hub 31. In the preferred embodiment, a plurality of blades 32 extend from the central hub 31 in a fan or pin-wheel type configuration. Further, the blades 32 may be integrally formed with the central hub 31, or attached as separate elements depending upon the manufacturing considerations.

Figure 1:
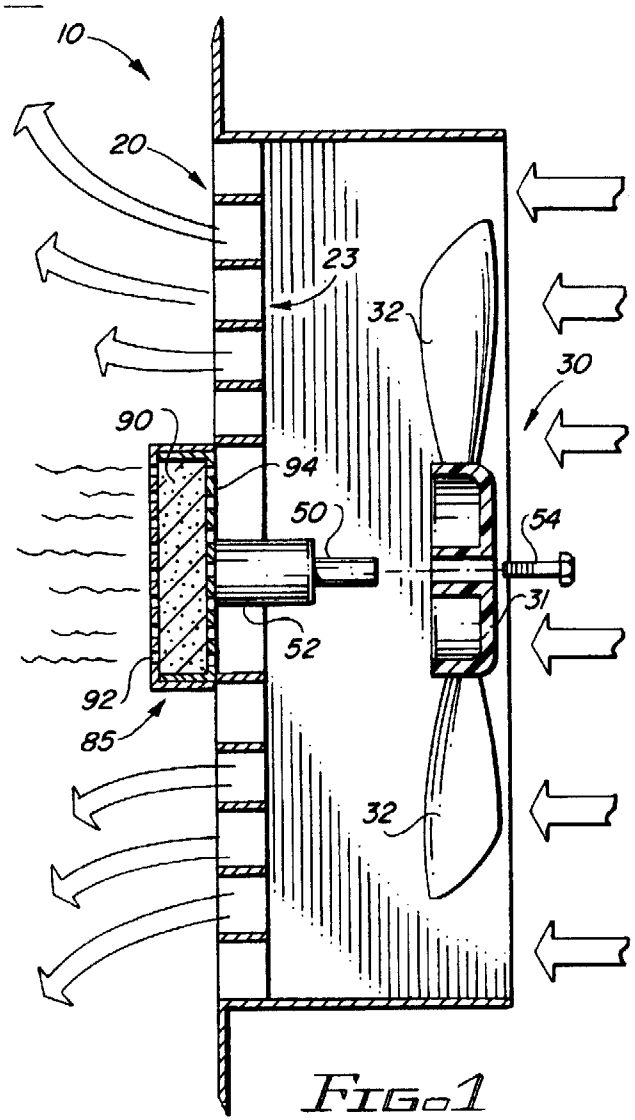
FIG. 1 is a cross-sectional view of the air conditioner vent cover assembly showing generally the frame, propeller assembly, and the direction of airflow.

Additionally, connected between a central axis 60 of the propeller assembly 30 and the frame 20 of the air conditioner vent cover assembly 10 are rotation means. The rotation means are structured and disposed to facilitate and permit the free rotation of the propeller assembly 30 as a result of airflow from the air conditioning duct flowing over the propeller assembly 30, as best shown in FIG. 1. Specifically, the rotation means allow free movement so that the natural forces of the airflow over the propeller assemblies 30 cause them to rotate and in turn disburse the air flow as it passes from the propeller assembly 30 through the exterior face 22 of the frame 20 of the air conditioner vent cover assembly 10. As such, without requiring any additional electrical connection or substantial modification, the bent cover assembly 10 is able to more evenly cool or heat an area into which the outlet vent 15 extends.

In the preferred embodiment, the rotation means include a central shaft 50 extending from the central hub 31 and aligned with the central axis 60 of the propeller assembly 30. Accordingly, the central shaft 50 defines an axis of rotation for the propeller assembly 30. As best shown in FIGS. 1 and 3, the central shaft 50 is preferably generally narrow and elongate, and includes a distal end 52 structured to be rotatably positioned within a bearing seat 70. The bearing seat 70, which is structured to facilitate the free rotation of the central shaft 50 and therefore the propeller assembly 30 in an efficient manner so that friction losses are minimized, is preferably mounted directly to the frame 20. Alternatively, however, a separate bracket may be secured to the frame 20 to facilitate securing of the bearing seat 70. Further, the bearing seat 70, which may take on a number of configurations, is preferably structured to retain the distal end 52 of the central shaft 50 therein during use. Moreover, the bearing seat 70 is preferably secured at or adjacent the exterior face 22 of the frame 20 such that the airflow over the propeller assembly 30 tends to urge the propeller assembly 30 and therefore the central shaft 50 into better engagement with the bearing seat 70. As can be appreciated, in the preferred embodiment, disposed opposite the distal end 52 of the central shaft 50 is a securement nut 54 which prevents the propeller assembly 30 from sliding off of the central shaft 50 and secures the central shaft 50 to the propeller assembly 30 such that they both rotate together. Nevertheless, it will be appreciated by those skilled in the art, that in an alternative embodiment, the central shaft 50 may be fixed so that it does not rotate, but rather it permits the propeller assembly 30 to rotate thereabout.

Also in the preferred embodiment, the air conditioner vent cover assembly 10 further includes scent dispersment means. Specifically, the scent dispersant means are structured and disposed to disperse an air freshener into the airflow exiting the air conditioner vent cover assembly 10, and thereby provide a pleasant aroma within the room. Preferably the scent dispersement means includes a housing 85 that includes and defines an interior compartment 33, as best shown in FIG. 1. Further, the scent dispersement means includes a plurality of flow through passages 34 defined in the housing 58. The flow through passages 34 are structured to extend completely through the interior compartment 33 and thereby permit air to flow into and out of the interior compartment 33 therethrough.

Structured to be contained within the interior compartment 33 of the housing 85, as part of the scent dispersement means, is an air freshener impregnated medium 90. The air freshener impregnated medium 90 is structured to be accessibly retained within the interior compartment 33 of the housing 85 so as to release a quantity of air freshener into the airflow passing through the flow through passages 34 of the housing 85. In the preferred embodiment, the air freshener impregnated medium 90 includes a sponge that is soaked with a scented liquid. As such, as airflow is directed towards the vent cover assembly 10 to be dispersed by the propeller assembly 30, a portion of the airflow passes through the housing 85 and picks up the aroma of the air freshener impregnated medium 90. It will be appreciated, however, by those skilled in the art that a wide array of known impregnated mediums may be utilized for this purpose, including a single solid air freshener element, or a gel or particle element. Also, in the preferred embodiment, the entire air freshener impregnated medium 90 may be disposable; however, it will be understood by those skilled in the art that the impregnated medium 90 may alternatively be reusable by simply re-impregnating the medium 90 with additional fragrance.

Further, because the air freshener impregnated medium 90 may have to be replaced periodically as the fragrance dissipates, the air conditioner vent cover assembly 10 is configured to permit facilitated access to the housing 85. For example, in the preferred embodiment the housing 85 will be disposed on an outer face of the exterior face 22 of the frame 20. In this embodiment, housing 85 preferably includes a base portion 94 mounted to the frame 20, and a removable lid 92 structured to be secured to the base 94 in any conventional, removable fashion, thereby permitting facilitated access to the air freshener impregnated medium 90. Additional, the lid 92 may have a decorative exterior appearance to match and/or blend in with the decorative appearance of the exterior face 22 of the frame 20. Alternatively, it should be noted that the central hub 31 of the propeller assembly may have an enlarged configuration to define the housing 85 therein.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents. For example, it is understood that the present invention could also be effectively utilized with wall mounted air conditioners, automobile air conditioners and other types of ventilation systems.

Now that the invention has been described,

What is claimed is:

1. To be disposed over an outlet vent of an air conditioner duct, an air conditioner vent cover assembly comprising:

a frame, said frame being structured for secure, fitted engagement over the outlet vent, said frame including an exterior face having a plurality of openings formed therein so as to permit air flow therethrough from the vent, at least one propeller assembly, said propeller assembly including a central hub and at least one blade extending from a perimeter of said central hub, said central hub being generally perpendicularly disposed to said exterior face of said frame and to a direction of flow of said air flow, rotation means connected between a central axis of said propeller assembly and said frame and structured to permit the free rotation of said propeller assembly as a result of air flow from said air conditioning duct flowing over said propeller assembly such that said air flow is dispersed as it passes from said propeller assembly through said exterior face of said frame to more evenly affect an area into which the outlet vent extends, and scent dispersement means structured and disposed to disperse an air freshener into said air flow upon passage of said air flow therethrough.

2. An air conditioner vent cover assembly as recited in claim 1 wherein said rotation means includes a central shaft extending from said central hub at said central axis of said propeller assembly.

3. An air conditioner vent cover assembly as recited in claim 2 wherein said central shaft includes a distal end structured to be rotatably positioned within a bearing seat mounted to said frame so as to provide for friction minimizing, free rotation of said central shaft and therefore said propeller assembly.

4. An air conditioner vent cover assembly as recited in claim 3 wherein said bearing seat is mounted on said exterior face of said frame such that a force of said air flow on said propeller assembly tends to maintain said central shaft within said bearing seat.

5. An air conditioner vent cover assembly as recited in claim 1 including two of said propeller assemblies disposed a spaced apart distance from one another and rotatably secured to said frame by said rotation means.

6. An air conditioner vent cover assembly as recited in claim 1 further including scent dispersement means structured and disposed to disperse an air freshener into said air flow upon passage of said air flow therethrough.

7. An air conditioner vent cover assembly as recited in claim 6 wherein said scent dispersement means include a housing defining an interior compartment, and including a plurality of flow through passages formed therein and structured to permit air flow through said interior compartment.

8. An air conditioner vent cover assembly as recited in claim 7 wherein said scent dispersement means further includes an air freshener impregnated medium structured to be contained within said interior compartment of said housing so as to release a quantity of said air freshener into said air flow passing thereover.

9. An air conditioner vent cover assembly as recited in claim 8 wherein said air freshener impregnated medium includes a liquid soaked sponge.

10. An air conditioner vent cover assembly as recited in claim 7 wherein said housing is secured to an outer face of said exterior face of said frame.

11. To be disposed over an outlet vent of an air conditioner duct, an air conditioner vent cover assembly comprising:

a frame, said frame being structured for secure, fitted engagement over the outlet vent, said frame including an exterior face having a plurality of openings formed therein so as to permit air flow therethrough from the vent, at least one propeller assembly, said propeller assembly including a central hub and at least one blade extending from a perimeter of said central hub, rotation means connected between a central axis of said propeller assembly and said frame and structured to permit the free rotation of said propeller assembly as a result of air flow from said air conditioning duct flowing over said propeller assembly such that said air flow is dispersed as it passes from said propeller assembly through said exterior face of said frame to more evenly affect an area into which the outlet vent extends, said central hub being generally perpendicularly disposed to said exterior face of said frame and to a direction of flow of said air flow, and scent dispersement means structured and disposed to disperse an air freshener into said air flow upon passage of said air flow therethrough.

12. An air conditioner vent cover assembly as recited in claim 11 wherein said scent dispersement means include a housing defining an interior compartment, and including a plurality of flow through passages formed therein and structured to permit air flow through said interior compartment.

13. An air conditioner vent cover assembly as recited in claim 12 wherein said housing is secured to an outer face of said exterior face of said frame so as to facilitate access to said interior compartment.

14. An air conditioner vent cover assembly as recited in claim 13 wherein said scent dispersement means further includes an air freshener impregnated medium structured to be contained within said interior compartment of said housing so as to release a quantity of said air freshener into said air flow passing thereover.

15. An air conditioner vent cover assembly as recited in claim 11 wherein said rotation means includes a central shaft extending from said central hub at said central axis of said propeller assembly.

16. An air conditioner vent cover assembly as recited in claim 15 wherein said central shaft includes a distal end structured to be rotatably positioned within a bearing seat mounted to said frame so as to provide for friction minimizing, free rotation of said central shaft and therefore said propeller assembly.

17. An air conditioner vent cover assembly as recited in claim 16 wherein said bearing seat is mounted on said exterior face of said frame such that a force of said air flow on said propeller assembly tends to maintain said central shaft within said bearing seat.

18. An air conditioner vent cover assembly as recited in claim 11 including two of said propeller assemblies disposed a spaced apart distance from one another and rotatably secured to said frame by said rotation means.

* * * * *